US008494431B2

(12) United States Patent
deJong et al.

(10) Patent No.: US 8,494,431 B2
(45) Date of Patent: Jul. 23, 2013

(54) DUPLEX SHEET REGISTRATION

(75) Inventors: Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 746 days.

(21) Appl. No.: 12/604,908

(22) Filed: Oct. 23, 2009

(65) Prior Publication Data

US 2011/0097125 A1 Apr. 28, 2011

(51) Int. Cl.
*G03G 15/00* (2006.01)
*B65H 7/02* (2006.01)

(52) U.S. Cl.
USPC ..... 399/395; 399/388; 271/227

(58) Field of Classification Search
USPC ..... 399/395
See application file for complete search history.

(56) References Cited

U.S. PATENT DOCUMENTS

| | | | | |
|---|---|---|---|---|
| 4,417,150 | A | 11/1983 | Moran | |
| 4,741,526 | A * | 5/1988 | Reed | 271/261 |
| 4,944,505 | A * | 7/1990 | Sherman, III | 271/265.03 |
| 5,930,577 | A * | 7/1999 | Forsthoefel et al. | 399/401 |
| 6,032,004 | A | 2/2000 | Mirabella, Jr. et al. | |
| 6,373,042 | B1 | 4/2002 | Kretschmann et al. | |
| 6,697,601 | B1 * | 2/2004 | Kamimura et al. | 399/388 |
| 7,500,668 | B2 | 3/2009 | DeJong et al. | |
| 2002/0006287 | A1 * | 1/2002 | Dobberstein et al. | 399/45 |
| 2006/0177253 | A1 * | 8/2006 | Aiko | 399/394 |
| 2006/0197038 | A1 * | 9/2006 | Park et al. | 250/559.37 |
| 2007/0085265 | A1 * | 4/2007 | DeJong et al. | 271/227 |
| 2008/0095560 | A1 * | 4/2008 | Larson et al. | 399/394 |
| 2009/0057992 | A1 * | 3/2009 | Katou et al. | 271/227 |
| 2009/0066016 | A1 * | 3/2009 | Kato et al. | 271/227 |
| 2011/0084441 | A1 * | 4/2011 | DeJong et al. | 271/227 |

FOREIGN PATENT DOCUMENTS

| | | | |
|---|---|---|---|
| JP | 62119535 | A * | 5/1987 |
| JP | 63066050 | A * | 3/1988 |
| JP | 2003075141 | A * | 3/2003 |

* cited by examiner

*Primary Examiner* — Ren Yan
*Assistant Examiner* — Nguyen Q Ha

(57) ABSTRACT

Sheet registration method and system includes transporting a sheet including a leading edge and a trailing edge between a first and second sensor. The first and second sensors each have a linear sensing area with a longitudinal axis aligned at a non-zero angle to each other. The first and second sensors are adapted to identify positions of the leading edge and the trailing edge. An alignment of the sheet is adjusted responsive to a sheet length determined using the output from the first and second sensors.

18 Claims, 7 Drawing Sheets

DUPLEX SHEET REGISTRATION

TECHNICAL FIELD

Embodiments disclosed herein relate generally to media registration and, more particularly, to media registration in duplex printers.

BACKGROUND

Office equipment, such as printers and copiers, which place images based on digital data onto sheets, such as sheets of paper, are well known. More sophisticated types of office equipment are capable of placing images on both sides of a single sheet of paper, a feature often referred to as "duplexing." A typical configuration of a duplexing printer (the word "printer" including other types of equipment, such as digital copiers and facsimile machines) will include a marking device, meaning some hardware which places a desired image on a sheet, which is capable of printing only on one side of the sheet at a time. In order to print on both sides of the same sheet, it is necessary to feed a sheet through the marking device the first time, so the sheet can receive a first image on one side thereof, and then invert the sheet and re-feed it back into the marking device so that the marking device can place a second image on the other side of the sheet. Although the specific architectures of various office equipment on the market varies widely, the path (along with any associated sheet-handling hardware, such as belts or rollers and motors) by which a sheet has been output by the marking device is inverted and re-fed to the marking device can be generally referred to as a "duplex path." In the market for office equipment having duplex features, a common customer requirement is a precise registration between an image printed on one side of the sheet with the image printed on the other side. However, positioning an image on one side of a sheet in a manner that coincides with the position of the image on the other side of the sheet can be difficult.

Registration of a first image on a first side of a sheet with a second image on a second side of a sheet is not always accurate because of one or more registration errors that offset the first image relative to the second image. For example, a page number printed on the bottom-center position of the first side of a two-sided, printed document should align exactly with the page number printed on the reverse side. The offset of the page number on the second side of a sheet with respect to the page number on the first side of the sheet is a registration error that is extremely undesirable, and considered unacceptable in various printing industries.

Registering two images on the front and back sides of a single sheet of media sheet is important in industries such as the offset printing industry. In this industry, duplex sheets are sometimes produced having a number of pages of what will ultimately be a single, multi-page document, aligned on the front and back of a single sheet of media sheet. To create such a multi-page document, a sheet of media sheet is printed with multiple images on the front and back side of a single composite sheet. The single composite sheet is subsequently folded and segmented into individual pages. Each of the images on a first side a sheet must therefore be registered with a corresponding image on a second side of the sheet before the sheet may be segmented into individual pages.

Specifically, the first image that appears on the first side of the sheet and the second image that appears on the second side of the sheet are positioned so that identical images printed on both sides of the sheet are coincident with each other. In other words, two identical images printed on both sides of a sheet of media sheet form mirror images of each other since each image is printed with no apparent offset from the other. Thus, an image on the front side of a sheet would appear to be in perfect or transparent registration with the corresponding image on the back side of the sheet.

The "show through" error that occurs when transparent registration is not achieved can be quantified by measuring of the displacement between two points, one on a first side of the sheet and one on a second side of the sheet, that are intended to be equidistant from a common sheet edge. This error is caused, at least in part, by the factors identified above. The portion of the error associated with media sheet shrinkage is often caused by fusing a printed image on the first side prior to printing of an image on the second side.

Accordingly, it is desirable to provide a sheet registration method and system for precisely registering an image on one side of a sheet with an image on the reverse side.

SUMMARY

According to aspects described herein, there is disclosed a method of media sheet registration for a printing apparatus including transporting a sheet of media including a leading edge and a trailing edge between a first and second sensor. The first and second sensors each have a linear sensing area with a longitudinal axis aligned at a non-zero angle to each other. The first and second sensors are adapted to identify positions of the leading edge and the trailing edge. An alignment of the sheet is adjusted responsive to a sheet length determined by using the output from the first and second sensors.

According to other aspects described herein, there is provided a method of duplex registration of a sheet having a first and second edge for a printing apparatus including sensing a first sheet edge to determine a sheet orientation prior to printing on a first sheet side. An image on a sheet first side is imparted responsive to the determined sheet orientation, and the sheet is inverted. A length of the sheet is measured using first and second edge sensors each having a linear sensing area with a longitudinal axis, wherein the longitudinal axis of the first and second sensors are aligned at a non-zero angle relative to each other, and wherein the first and second sensors are adapted to identify positions of the first and second sheet edges. A sheet skew angle is determined using output from the first and second edge sensors. A sheet length is determined between the first edge and the second edge of the sheet using output from the first and second edge sensors and the sheet skew angle. An image is imparted on a sheet second side responsive to the calculated sheet length.

According to further aspects described herein, there is provided a sheet registration system for a printing apparatus including a sheet adjustment device adapted to adjust the position of a media sheet having a leading edge and a trailing edge. A first and second sensor are spaced along a path over which the media sheet travels and are adapted to identify positions of the leading edge and the trailing edge. The first and second sensors each having a linear sensing area with a longitudinal axis, wherein the longitudinal axis of the first and second sensors are aligned at a non-zero angle relative to each other. A registration controller is operatively connected to the sheet adjustment device and to the first and second sensors. The registration controller is operatively connected to the sheet adjustment device and to the first and second sensors. The registration controller affects the operation of the sheet adjustment device in response to a sheet length determined using output from the first and second sensors.

DETAILED DESCRIPTION

Figure 1:
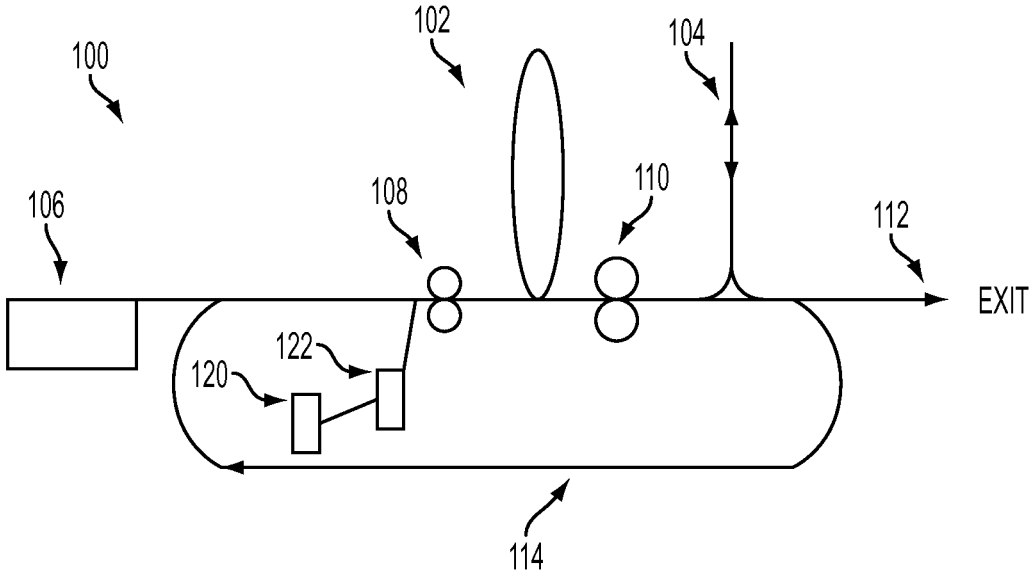
FIG. 1 is a schematic representation of a duplex media sheet path.

The term "printer" as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. Embodiments herein are applicable to monochrome printing apparatus as well as those that print in color or handle color image data.

As used herein, "sheet media" refers to, for example, paper, transparencies, parchment, film, fabric, plastic, or other substrates on which information can be reproduced.

As used herein, "sensor" refers to a device that responds to a physical stimulus and transmits a resulting impulse for the measurement and/or operation of controls. Such sensors include those that use pressure, light, and motion. Also, each of such sensors as referred to herein can include one or more point sensors and/or array sensors for detecting and/or measuring characteristics of a substrate media such as speed, orientation, process or cross-process position and even the size of the substrate media. Thus, reference herein to a "sensor" can include more than one sensor.

As used herein, "linear sensing area" refers to a longitudinally extending area along which the presence of an object such as a sheet of media may be detected by a sensor.

As used herein, "non-zero angle" refers to any angle between to a linear axis which is greater or less than zero.

As used herein, "skew" refers to a physical orientation of a substrate media relative to a process direction. In particular, skew refers to a misalignment, slant or oblique orientation of an edge of the substrate media relative to a process direction. The term "sheet skew angle" as used herein refers to the angular deviation of a media sheet relative to the process direction.

As used herein, "sheet length" refers to the dimension of a media sheet in the process direction, e.g. the distance between the leading edge and the trailing edge.

As used herein, "registration correction factor" refers to a variable which corresponds to a deviation of a media sheet, or property thereof, from a desired value, wherein the deviation affects sheet registration.

As used herein, "invert" refers to reversing the orientation of a sheet with respect to a process direction such that the leading edge becomes the trailing edge.

As used herein, "sheet adjustment device" refers to a mechanism for positioning a sheet of media, such mechanism may include, for example, one or more nip assemblies.

As used herein, "registration controller" refers to a device or devices for influencing the registration of a media sheet and may include hardware and or software and any conventional logic/memory unit capable of performing comparisons, storing values, storing and executing logical routines.

A major error source in side 1-side 2 registration is from media sheet size change that occurs during fusing of the first side printing. The lead edge of the sheet on side 1 becomes the trail edge on side 2 (after inversion). At the input of the registration system, the process and skew (angle) orientation can be established from measurement on the lead edge of side 1. After inversion, what was previously the trail edge, now becomes the lead edge. Hence, any sheet size tolerances will contribute to side 1-side 2 registration errors.

As discussed in greater detail below, embodiments herein provide a system and method of using a pair of sheet edge position sensors. These sensors measure the sheet lead edge and trail edge position in a multitude of locations at the same or approximately the same time. The dimension of the sheet in the process direction, i.e., sheet length, L, can be calculated. A sheet registration controller compensates for these errors by adding appropriate offsets to the registration targets to improve side 1-side 2 registration errors.

As shown in the duplex media sheet path 100 in FIG. 1, media sheets are fed from a feeder 106, and transported along the path 100. The sheets are registered with a media sheet registration system 108 before receiving the image from a marking device 102. Marking device 102 can be of any type known in the art, such as an electrophotographic "laser printer" device, or can alternately be an ink jet printer with a reciprocating printhead, or an ink jet printer with a page with printhead. Once an image is imparted on the media sheet, the image is then fused onto the media sheet by the fuser 110 and the sheet may or may not be inverted by the inverter 104 before it passes through the exit 112. Conventional marking devices, fusers, media sheet paths, etc. are discussed at length in U.S. Pat. No. 6,032,004. For duplex printing, the sheet is inverted and routed through the duplex path to present side 2 to the imaging device. Note that inversion may also take place in the duplex path. Inversion transposes the lead edge (LE) and trail edge (TE).

A length sensor unit 120 may be positioned in the duplex path 114; however, this location is merely one example and the length sensor unit 120 could be located at any location of the sheet path 100 that allows the sheet to be observed before or after the first side printing is completed (and, therefore, after the media sheet has shrunk from the heating during the fusing of the first side printing), but before registration for the second side printing is performed. The length sensor unit 120 is shown in greater detail in FIG. 4 discussed below. A registration controller 122 is connected to, among other items, the length sensor unit 120 and the media sheet registration system 108. The registration controller 122 can comprise any conventional logic/memory unit capable of performing comparisons, storing values, storing and executing logical routines, etc. Such controllers are widely available from computer manufactures, such as Intel Corporation, Santa Clara, Calif., USA, etc. Note that, in some embodiments, the length sensor unit 120 and the registration controller 122 could be combined into a single unit.

Figure 2:
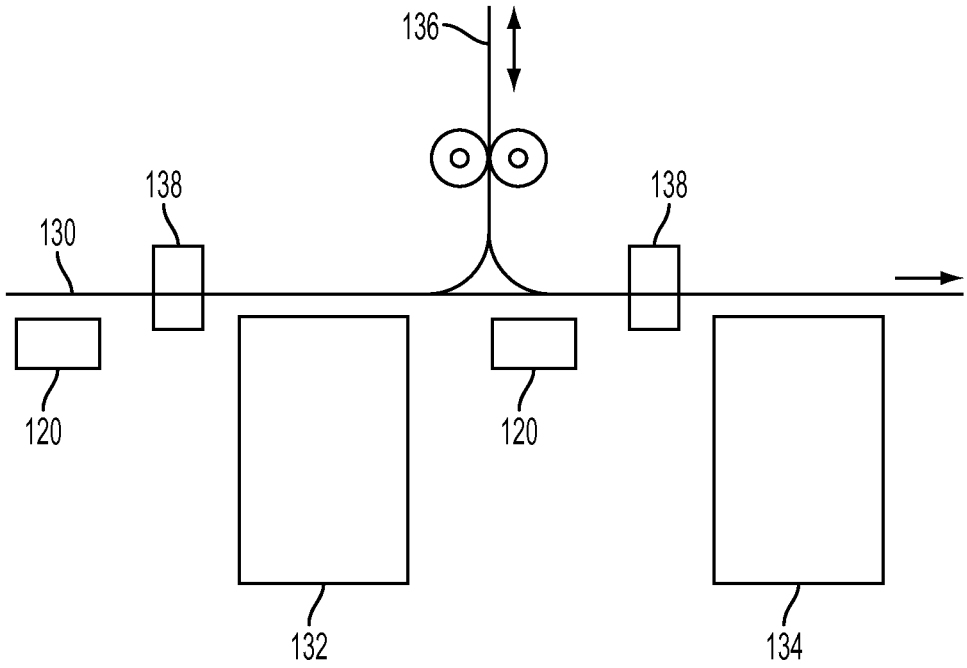
FIG. 2 is a schematic representation of an alternative embodiment of a duplex media sheet path having multiple marking devices.

As shown in FIG. 2, an alternative duplex media sheet path 130 may include a first marking device 132 and a second marking device 134 disposed downstream from the first marking device. An inverter 136 may be disposed between the first and second marking devices to affect duplex printing. A length sensor unit 120 may be positioned along the sheet path between the second marking device 134 and the inverter 136. A registration system 138 may be positioned along the path between the second marking device 134 and the length sensor unit 120. Accordingly, a sheet may be sensed by the length sensing unit 120 and acted upon by the registration system 138 before printing on the second side of the sheet.

Figure 3:
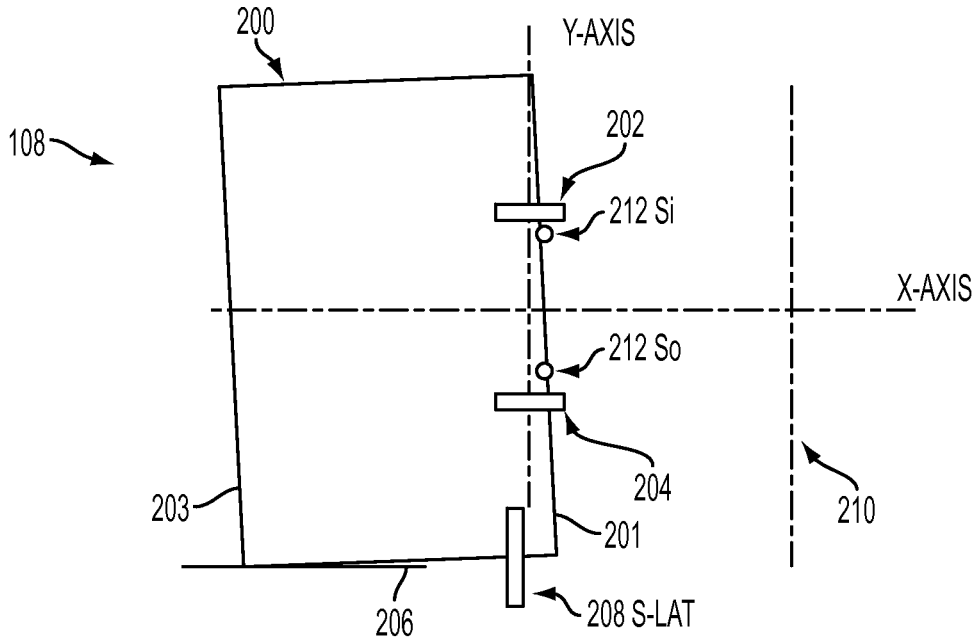
FIG. 3 is a schematic representation of a media registration system.

The media sheet registration system 108 is shown in greater detail in FIG. 3 and measures the position of the media sheet 200 when it arrives at the registration system 108. Lateral, process and skew are measured with a plurality of registration sensors 212. For example, sensors Si and So measure the time of arrival of the leading edge 201 of the media sheet 200. The average time of arrival ((Si+So)/2) is used for process direction correction. For example, the difference in time of arrival (at Si and So) can be multiplied by the sheet velocity and divided by the registration sensor spacing as a measurement of the sheet angle Beta 206. The sensor S-lat 208 measures the lateral sheet position. This method measures sheet position before commencing the registration move. The angle and position of the sheet 200 are adjusted by unequal rotation of the inboard and outboard nip drives 202, 204 and the correction is performed so that the sheet can enter the image transfer location 210 without skew/misalignment. The system 108 with sensors So and Si may detect the leading edge so that the position of the sheet may be adjusted prior to the first side of the sheet being printed.

As mentioned above, the inverter 104 transposes the leading edge 201 and the trailing edge 203 of the media sheet 200. Therefore, when the sheet 200 again enters the media sheet registration system 108, the trailing edge (now the leading edge) is interrogated by sensors Si, So, and S-lat. However, if the dimensions of the sheet change during processing, the registration for the first side will be different than that of the second side in the process (X) direction, leading to registration error. In order to correct for and prevent such registration errors, it is desirable to register the sheet 200 using the same edge for both the side 1 print and the side 2 print. Prior to side 2 printing, the leading edge (formally the trailing edge) enters the registration nips 202 and 204 and its position is determined by sensors Si, So and S-lat. If the sheet length is also known, the position of the trailing edge (formally the leading edge) can be determined. Therefore, registration for the side 2 printing can be performed based on the trailing edge, i.e., the same edge that was used for the first side printing. Since the registration for both the first side and second side printing is based on the same sheet edge, the image placement on both sheet sides can be precisely controlled and registration errors reduced.

Figure 4:
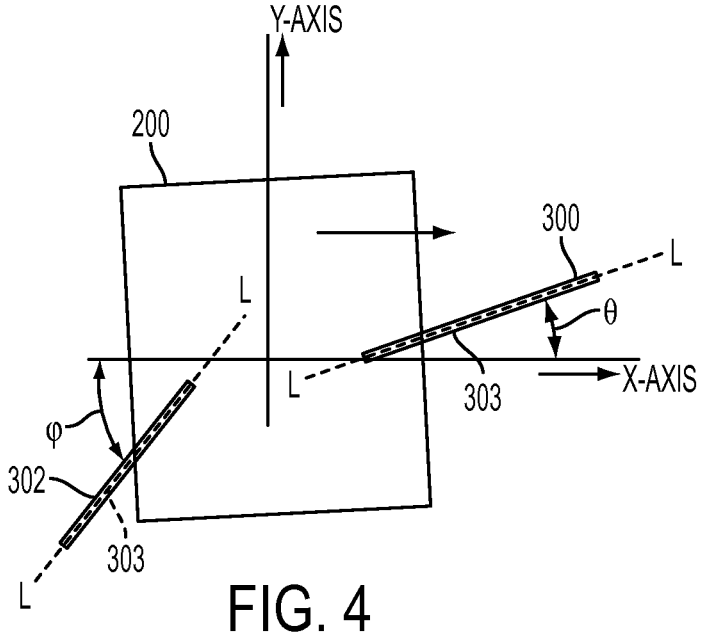
FIG. 4 is a schematic representation of media registration system and sheet edge sensors.
Figure 5A:
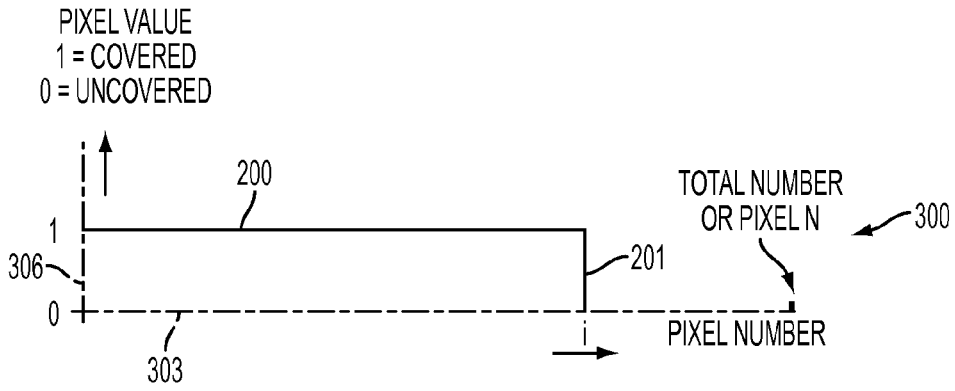
FIG. 5A is a graphic representation of a leading edge sheet sensor response.
Figure 5B:
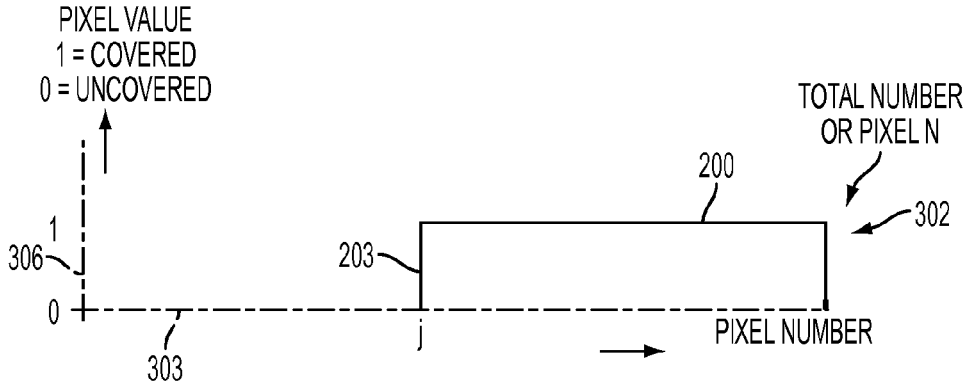
FIG. 5B is a graphic representation of a trailing edge sheet sensor response.

In order to measure the sheet length, the sheet length sensor unit 120 uses a first and second sheet edge position sensor 300 and 302, as show in FIG. 4. The first and second sheet edge position sensors 300, 302 may each have a longitudinal extent and include a generally linear sensing area 303 which can sense the edge of the sheet as it travels over the sensing area. The linear sensing area of both sensors extends along a longitudinal axis L-L. The sensing area 303 is able to sense a sheet, and, in particular, the sheet edge as it travels along the longitudinal axis of the edge position sensor. The first and second edge position sensors may be, for example, a contact image sensor model IA6008-FA30A manufactured by Rohm, or any other sensor that can detect a media sheet edge. The first and second edge position sensors 300 and 302 can comprise any conventional sensors that are used in office automation communication devices (fax machines), electronic toys, etc. Such sensors are widely available and relatively inexpensive. Alternatively, the edge position sensors may include a plurality of individual sensors arranged in a line. With embodiments herein, the first and second sensors 300, 302 report the position of each relative edge that is adjacent to a given sensor to the registration controller 122 (FIG. 1). In one example shown in FIGS. 5A and 5B, the signal processing circuitry for each edge position sensor may have a linear array of N number or pixels which form the sensing area 303. When a portion of the sensing area 303 is covered by the sheet 200, the pixel value 306 changes from 0 to 1. Output of the number of pixels that are covered by the sheet indicate the sheet edge position. For example, with reference to FIG. 5A, at pixel number i, there is a transition from 1 to 0 which indicates the position of the sheet leading edge 201. With reference to FIG. 5B, at pixel j, there is a transition from 0 to 1 indicating the position of the trailing edge 203. The edge position on the sensor can then be calculated by the first and second sensors 300 and 302 or the registration controller 120.

Figure 6:
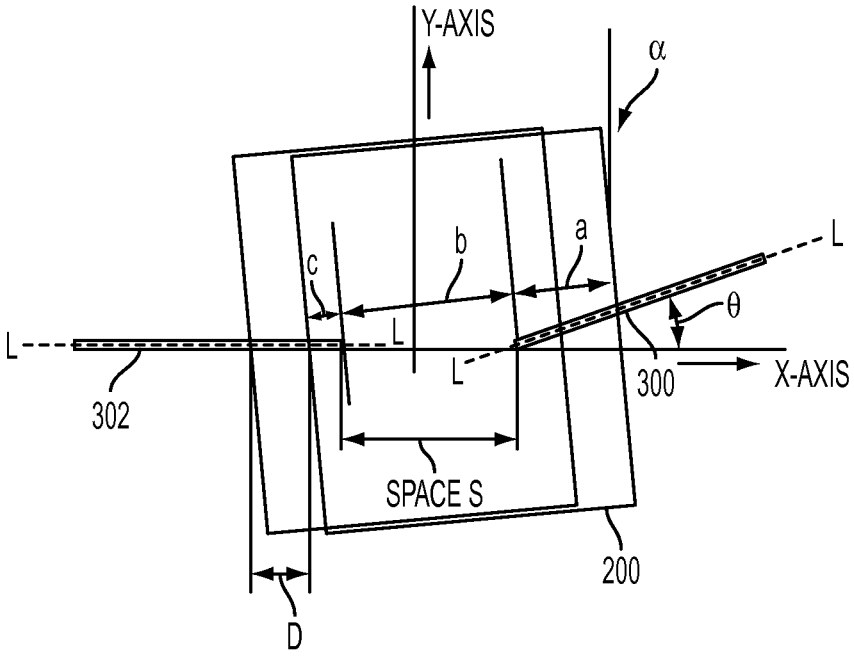
FIG. 6 is a schematic representation of media registration system showing an alternative arrangement of the sheet edge sensors.

With reference to FIG. 6, as the sheet is transported across the sensors 300 and 302, the sheet LE and TE positions are measured by the first and second sensors 300 and 302, respectively. At two instances in time, the sheet edge position measurements are collected from the sensors 300 and 302. The sheet has moved a distance D between the two sets of measurements. The first and second sensors 300 and 302 are positioned relative to each other such that longitudinal axis L-L of the first and second edge position sensors are aligned at a non-zero angle to each other. Accordingly, the linear sensing areas 303 are in non-parallel alignment to each other. This permits the sheet angle α, or skew, to be calculated which in turn permits for precise measurement of the sheet length as set forth below. In one embodiment shown in FIG. 4, both of the first and second sensors may be positioned at an angle with respect to the process direction X. Alternatively, as shown in FIG. 6, one of the first and second sensors may be aligned in the process direction X and the other sensor may be positioned at an angle to the process direction. By aligning the edge position sensors 300 and 302 so that they are at a non-zero angle to each other, the sheet length can be accurately measured using just the two sensors. Therefore, cost and complexity of the registration system are reduced.

With further reference to FIG. 6, the length of the sheet 200 may be calculated as herein described. In this embodiment, the first edge position sensor 300 is positioned at an angle θ relative to the process direction (X). The second edge position sensor 302 may be aligned with the process direction (X). First edge position sensor 300 may generate two readings A1 and A2 regarding the position of the leading edge at the times T1 and T2. Second edge position sensor 302 may generate two readings B1 and B2 regarding the position of the trailing edge at the times T1 and T2. In the time interval, ΔT1−2, the sheet has moved a distance D. D=B2×B1 as measured by second sensor 302 which in this embodiment is aligned with the process direction X.

The difference in position of the leading edge detected by the first edge position sensor 300 is calculated by the following equation:

$$A2-A1=D^{*}\cos(\alpha)/\cos(\theta-\alpha). \quad \text{(Equation 1)}$$

To solve the sheet angle α the following equation may be used:

$$\alpha=\arctan((D/(A2-A1)-\cos(\theta))/\sin(\theta) \quad \text{(Equation 2)}$$

The sheet length, L, can then be calculated as follows:

$$L=a+b+c$$

$$A=A2*\cos(\theta-\alpha)$$

$$B=S*\cos(\alpha)$$

$$C=\text{length of second sensor},SB,*\cos(\alpha)\text{or}$$

$$L=(D*A2/(A2-A1)+(\text{Length } SB-B2))*\cos(\alpha) \quad \text{(Equation 3)}$$

Multiple readings can be taken as the sheet 200 moves across the sensors 300 and 302. Statistical averaging may be employed to improve accuracy of the measurement.

In the embodiment shown in FIG. 4, sensor 302 is positioned at an angle $\phi$ to the process direction (X). Therefore, the sheet length can be calculated as follows:

$$B2-B1=D*\cos(\alpha)/\cos(\phi-\alpha) \quad \text{(Equation 4)}$$

Equations 1 and 2 form two equations with two unknowns, i.e. the sheet skew angle $\alpha$ and the distance D. Hence, $$\frac{B2-B1}{A2-A1}=\frac{\cos(\theta-\alpha)}{\cos(\varphi-\alpha)}=\frac{\cos(\theta)\cos(\alpha)+\sin(\theta)\sin(\alpha)}{\cos(\varphi)\cos(\alpha)+\sin(\varphi)\sin(\alpha)} \quad \text{(Equation 5)}$$

The ratio R=(B2−B1)/(A2−A1) is computed from the sensor readings. Hence, the only unknown is the sheet angle $\alpha$. Reworking the above equation yields $$(R*\cos((\phi)-\cos(\theta))*\cos(\alpha)=(-R*\sin(\phi)+\sin(\theta))*\sin(\alpha)$$

Or, the sheet skew angle $\alpha$ is computed from $$\alpha=\arctan\frac{R*\cos(\varphi)-\cos(\theta)}{-R*\sin(\varphi)+\sin(\theta)} \quad \text{(Equation 6)}$$

The sheet length L is calculated from $$L=a+b+c$$

$$a=A2*\cos(\theta-\alpha)$$

$$b=S*\cos(\alpha)$$

$c$=(Length$SB-B2$)*cos($\phi-\alpha$),where Length SB is the length of the second edge sensor 302.

The non-zero angle between the sensors permits equation 5 to be solved in order to determine the sheet angle $\alpha$. The sensor angles may be chosen to accommodate a particular application and the angle between the sensors can vary substantially. Practical values of the difference in sensor angles ($\phi-\theta$) are approximately from +/−5 degrees to +/−120 degrees. These ranges are exemplary and not intended to be limiting.

In positioning the edge position sensors 300 and 302, it is desirable that neither of the sensor angles $\phi$ and a be close to 90 degrees relative to the process direction (X), since the sheet edges should be on the sensors when the readings are taken at times t1 and t2 (the paper travels a distance D during that time).

Figure 7:
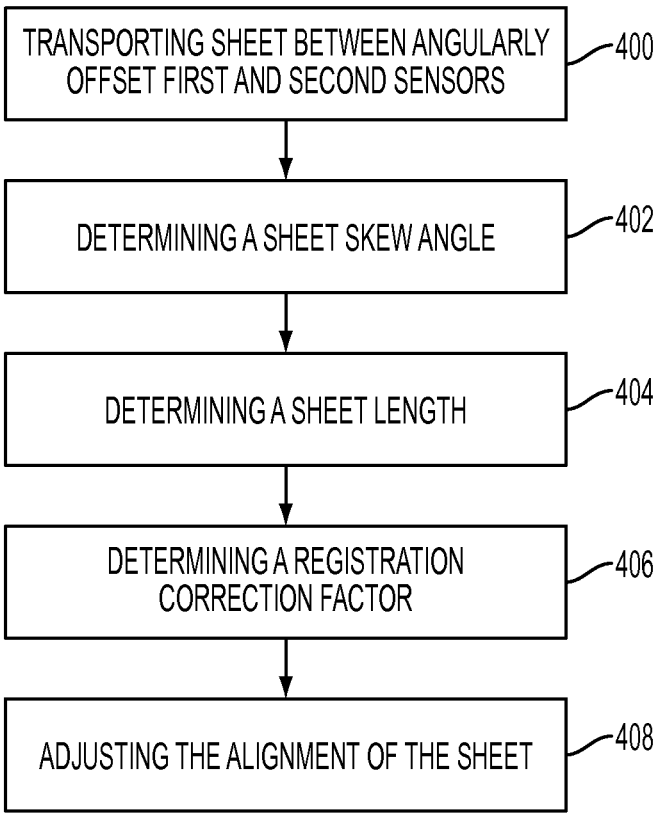
FIG. 7 is a flow diagram illustrating a process embodiment.

As shown in flowchart form in FIG. 7, in a method embodiment herein a sheet 200 is transported past the first and second edge position sensors 400. The sensing area of the edge position sensors detects the sheet and generates and output. The skew angle $\alpha$ is determined using the output from the first and second sensors 402. The length between the leading edge and the trailing edge of the media sheet is determined using the output from the first and second edge position sensors and the skew angle 404. A registration correction factor is determined based upon the length 406. The correction factor indicates divergences from a predetermined length standard. For example, if the sheet length has been shortened by its passage through the fuser, the change in length can be calculated and used to correct the registration when the second side is printed. The sheet registration controller may compensate for the change in length by adding appropriate offsets to the registration targets to improve side 1-side 2 registration errors.

The method corrects the alignment of the first items printed on the first side of the media sheet with the second items printed on the second side of the media sheet using the registration correction factor 408. When correcting the alignment, the embodiments adjust the position of the media sheet with respect to a position of a marking device to compensate for the divergences. The positioning of the media sheet is performed after the first items are printed on the first side of the media sheet and before the second items are printed on the second side of the media sheet so that media size changes that occur during the fusing process of the first side printing can be included in the correction factor.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of media sheet registration for a printing apparatus comprising:

transporting a sheet of media including a leading edge and a trailing edge in a process direction between a first and a second sensor, the first and second sensors each having a linear sensing area with a longitudinal axis, the first sensor being spaced from the second sensor a distance along the process direction, wherein the longitudinal axis of the first and second sensors are aligned at a non-zero angle relative to each other, and the first sensor is adapted to identify the position of the leading edge and the second sensor is adapted to identify the position of the trailing edge, wherein the longitudinal axis of the first sensor forms a first angle relative to the process direction and the longitudinal axis of the second sensor forms a second angle relative to the process direction and the absolute difference between the first and second angles is in the range of 5 to 120 degrees; and adjusting an alignment of the sheet responsive to a sheet length as measured between the leading and the trailing edge determined using the output from the first and second sensors.

2. The method of claim 1, wherein the sensors are adapted to simultaneously identify the locations of the leading edge and the trailing edge.

3. The method of claim 1, wherein the longitudinal axis of one of the first and second sensors is substantially aligned with the process direction and the other of the first and second sensors is aligned at a non-zero angle relative to the process direction.

4. The method of claim 1, wherein the sheet travels in the process direction and the longitudinal axis of one of the first and second sensors is disposed at a non-zero angle to the process direction.

5. The method of claim 1, including determining a sheet skew angle using output from the first and second sensors and determining the sheet length responsive to the skew angle.

6. The method of claim 1, including determining a sheet skew angle using output from the first and second sensors and determining the sheet length responsive to the skew angle.

7. The method of claim 1, wherein adjusting the alignment of the sheet includes correcting an alignment of first items printed on a first side of the media sheet with second items printed on a second side of the media sheet using a registration correction factor.

8. The method according to claim 1, wherein the correction factor indicates divergence from a predetermined length standard.

9. The method according to claim 1, wherein adjusting the alignment adjusts a position of the media sheet with respect to a position of a marking device.

10. The method according to claim 1, wherein the positioning of the media sheet is performed after first items are printed on the first side of the media sheet.

11. A method of duplex registration of a sheet having a first and second edge for a printing apparatus comprising:

sensing a first sheet edge to determine a sheet orientation prior to printing on a first sheet side;

imparting an image on a sheet first side responsive to the determined sheet orientation;

inverting the sheet;

measuring a length of the sheet between a leading and trailing edge using first and second edge sensors, the first and second sensors being spaced from each other in a process direction, and each having a linear sensing area with a longitudinal axis, wherein the longitudinal axis of the first and second sensors are aligned at a non-zero angle relative to each other, and wherein the first and second sensors are adapted to identify positions of the first and second sheet edges and wherein the longitudinal axis of the first sensor forms a first angle relative to the process direction and the longitudinal axis of the second sensor forms a second angle relative to the process direction and the absolute difference between the first and second angles in the range of 5 to 120 degrees;

determining a sheet skew angle using output from the first and second edge sensors;

determining a sheet length between the first edge and the second edge of the sheet using output from the first and second edge sensors and the sheet skew angle; and imparting an image on a sheet second side responsive to the calculated sheet length.

12. The method of claim 11, including sensing the second sheet edge to determine an orientation of the sheet prior to printing on a second sheet side and using the sheet length and the determined sheet orientation to adjust the alignment of the sheet.

13. A sheet registration system for a printing apparatus comprising:

a sheet adjustment device adapted to adjust the position of a media sheet having a leading edge and a trailing edge;

a first and second sensor spaced from each other along a path over which the media sheet travels and adapted to identify positions of the leading edge and the trailing edge, the first and second sensors each having a linear sensing area with a longitudinal axis, wherein the longitudinal axis of the first and second sensors are aligned at a non-zero angle relative to each other, and wherein the longitudinal axis of the first sensor forms a first angle relative to a process direction and the longitudinal axis of the second sensor forms a second angle relative to the process direction and the absolute difference between the first and second angles in the range of 5 to 120 degrees; and a registration controller operatively connected to the sheet adjustment device and to the first and second sensors, wherein the registration controller affects the operation of the sheet adjustment device in response to a length of the sheet between the leading and trailing edge determined using output from the first and second sensors.

14. The system of claim 13, wherein the registration controller determines a registration correction factor responsive to the determined sheet length.

15. The system of claim 14, wherein the sheet alignment device corrects an alignment of the first items printed on the first side of the media sheet with the second items printed on the second side of the media sheet using the registration correction factor.

16. The system according to claim 14, wherein the correction factor indicates divergences from a predetermined length standard.

17. The system according to claim 13, wherein the first and second sensors are adapted to identify the locations of the leading edge and the trailing edge after the first items are printed on the first side of the media sheet.

18. The system according to claim 13, wherein the registration controller determines a sheet skew angle using output from the first and second sensors and the determination of the sheet length is dependent on the skew angle.

* * * * *